US006838135B2

(12) United States Patent
Kasahara

(10) Patent No.: US 6,838,135 B2
(45) Date of Patent: Jan. 4, 2005

(54) INK-JET RECORDING PAPER

(75) Inventor: Kenzo Kasahara, Tokyo (JP)

(73) Assignee: Konica Corporation, Tokyo (JP)

( * ) Notice: Subject to any disclaimer, the term of this patent is extended or adjusted under 35 U.S.C. 154(b) by 40 days.

(21) Appl. No.: 10/215,933

(22) Filed: Aug. 9, 2002

(65) Prior Publication Data

US 2003/0104177 A1 Jun. 5, 2003

(30) Foreign Application Priority Data

Aug. 17, 2001 (JP) ..... 2001-247766

(51) Int. Cl.[7] ..... B41M 5/40

(52) U.S. Cl. ..... 428/32.31; 428/32.35; 347/105

(58) Field of Search ..... 428/32.31, 32.35, 428/32.34; 347/105

(56) References Cited

U.S. PATENT DOCUMENTS 4,832,984 A 5/1989 Hasegawa et al.
6,114,020 A * 9/2000 Misuda et al. ..... 428/32.35
6,357,871 B1 * 3/2002 Ashida et al. ..... 347/106

FOREIGN PATENT DOCUMENTS

EP 0 992 359 A2 4/2000
EP 1 016 542 A1 7/2000

OTHER PUBLICATIONS

Patent Abstracts of Japan of JP 2003–335049, (Nov. 25, 2003), KO Yukako et al., "Inkjet Recording Paper".
Patent Abstracts of Japan, vol. 0122, No. 82 (M–726), Aug. 3, 1988 of JP 63 060784 A (Fuji Photo Film Co. Ltd.), Mar. 16, 1988.

* cited by examiner

*Primary Examiner*—B. Shewareged
(74) *Attorney, Agent, or Firm*—Frishauf, Holtz, Goodman & Chick, P.C.

(57) ABSTRACT

An ink-jet paper is disclosed. The ink-jet paper has an ink receiving layer and a porous layer on the first ink absorption porous layer and the ink absorption porous layer contains organic fine particles which contains a polymer containing a repeating unit represented by Formula 1 as a copolymer constituent in a ratio of not less than 5% by weight and has a glass transition point Tg of not less than 70° C. and an average particle diameter of not more than 100 nm Formula 1

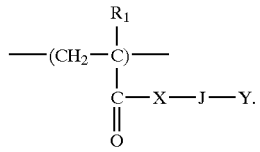

14 Claims, No Drawings

INK-JET RECORDING PAPER

FIELD OF THE INVENTION

The present invention relates to an ink-jet recording sheet.

BACKGROUND OF THE INVENTION

Ink-jet recording is carried out in such a manner that fine ink droplets are jetted onto a recording sheet such as a paper sheet, employing various working principles so that images and text are recorded. Said ink-jet recording exhibits advantages such as relatively high speed, low noise, and easy multicolor reproduction.

Conventional drawbacks with nozzle clogging and maintenance in said recording method have been overcome due to improvement of both inks and devices. As a result, at present, said recording method has been increasingly applied to various fields such as various types of printers, facsimile machines, and computer terminals.

Recently, said printers have been particularly improved so as to produce high quality images which approach conventional photographic image quality. Accordingly, needed are recording sheets capable of realizing conventional photographic quality and of further reproducing conventional photographic print-like properties (glossiness, smoothness and toughness).

In order to reproduce such conventional photographic print-like properties, developed as conventional recording sheets have been so-called swelling type sheets which are prepared by applying hydrophilic binders such as gelatin and polyvinyl alcohol onto a support. However, said sheets exhibit drawbacks such as slow ink absorption, surface stickiness after printing, and ease of image bleeding due to the presence of moisture during storage. Particularly, it is very difficult to reach the conventional photographic image quality due to the fact that since the ink absorption rate is low, prior to ink absorption, ink droplets are blended with each other, tending to result in bleeding between different colors and beading within the same colors.

Instead of said swelling type recording sheets, a so-called porous type recording sheet has now been playing a major role. Said porous type recording sheet exhibits a feature in that since ink is absorbed into multiple fine voids, the ink absorption rate is high. Examples of recording sheets, which achieve conventional photographic image quality, as well as conventional photographic print-like properties, as described above, are described in Japanese Patent Publication Open to Public Inspection Nos. 10-119423, 10-119424, 10-175364, 10-193776, 10-193776, 10-217601, 11-20300, 11-106694, 11-321079, 11-348410, 10-178126, 11-348409, 2000-27093, 2000-94830, 2000-158807, and 2000-211241.

On the other hand, in addition to said image quality and conventional-print like properties, higher level of durability as well as image retention properties has been demanded and much researches has been conducted to improve light fastness, moisture resistance, and water resistance to the level of silver halide photography. For example, regarding improvement of the light fastness, many techniques are disclosed in Japanese Patent Publication Open to Public Inspection Nos. 57-74192, 57-87989, 57-74193, 58-152072, 64-36479, 1-95091, 1-115677, 3-13376, 4-7189, 7-195824, 8-25796, 11-321090, 11-277893, 2000-37951.

In addition to the light fastness problem, porous type recording sheets have a problem in which, due to the multiple-void structure, discoloration and fading tend to occur due to harmful gases. Water-soluble phthalocyanine based dyes, which are employed in common color ink-jet printers, tend to result in said problem.

The mechanism of said discoloration and fading has not yet been fully clarified. However, it is assumed that a very small amount of active harmful gases such as ozone, oxidants, $SO_x$, and $NO_x$ in ambient air decomposes said dyes, since the multiple-void structure has a large surface area and an active surface of inorganic fine particles.

Techniques for reducing said discoloration and fading are described in Japanese Patent Publication Open to Public Inspection Nos. 63-252780, 64-11877, 1-108083, 1-216881, 1-218882, 1-258980, 2-188287, 7-237348, 7-266689, 8-164664, and others. However, recording sheets for producing photographic image quality, utilizing a finer multiple-void structure than conventional, tend to be more readily degraded. Accordingly, conventional improvement techniques have not resulted in sufficient effects and more essential improvement has been demanded.

Said swelling type recording sheets tend to result in fewer such problems, but exhibit inherent difficulty to improve the low ink absorption rate.

It is possible to overcome discoloration and fading problems by utilizing an ink-jet recording method in which a pigment-based ink is used. However, drawbacks such as bronzing on the recording sheet surface have not been overcome so as to result in sufficiently acceptable image quality in terms of overall product quality. Further, the following gas insulation methods are very effective: prints are subjected to a lamination treatment or placed in a frame, or as described in Japanese Patent Publication Open to Public Inspection Nos.53-27426, 59-222381, 62-271781, 11-157207, 11-245507, and 2000-71608, recording sheets, comprising fine thermoplastic particles on the surface, are printed, and subsequently heated or pressed to result in formation of a gas insulation layer. However, each of said methods needs a post-treatment to result in an additional manufacturing process.

SUMMARY OF THE INVENTION

The object of the invention is to provide ink-jet recording paper which is excellent in the ink absorption ability and inhibits the deterioration of the image formed on the recording paper by a harmful gas, further in detail, to provide ink-jet recording paper capable of giving the image which is inhibited in the color fading and has a high resistively against beading, a high thermal resistively and a high printed image density.

The invention and its embodiment are described.

An ink-jet paper having, provided on a support, an ink receiving layer and an ink absorption porous layer provided on the ink receiving layer, wherein the ink absorption porous layer contains organic fine particles which contains a polymer containing a repeating unit represented by Formula 1 as a copolymer constituent in a ratio of not less than 5% by weight and has a glass transition point Tg of not less than 70° C. and an average particle diameter of not more than 100 nm,

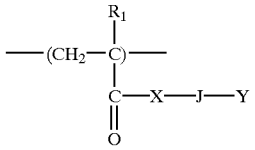

in the formula, X is —O— or —N($R_2$)—, $R_1$ is a hydrogen atom or a methyl group, $R_2$ is an alkyl group having 1–8 carbon atoms, and in case that X is —O—, J is an alkylene group having 2–18 carbon atoms which may have ether or thiother structure, and Y is a hydroxy, alkoxy, or carbamoyl group, and in case that X is —N($R_2$)—, J is a simple bond, or an alkylene group having 2–18 carbon atoms which may have ether or thiother structure, and Y is a hydrogen atom, a hydroxy, amino, alkoxy, or carbamoyl group X is preferably —O—, and Y is preferably a hydroxy group. $R_2$ is preferably an alkyl group having 1–8 carbon atoms.

The content of the repeating unit represented by Formula 1 is preferably 10% to 50% by weight in the polymer of the organic fine particle.

The ink absorption porous layer preferably further contains inorganic fine particles.

The ink absorption porous layer contains the organic fine particles preferably in a weight ratio of from 50% to 90% of the solid ingredient of the ink absorption porous layer and the inorganic fine particles preferably in a weight ratio of from 10% to 50% to the weight of the organic fine particles.

The thickness of the ink absorption porous layer is preferably 0.1 μm to 5 μm, and the ink receiving layer contains inorganic fine particles and preferably has a thickness of from 5 μm to 50 μm.

The organic fine particles is preferably insoluble in water and soluble in an organic solvent.

The ink receiving layer preferably comprises inorganic fine particles and a binder.

The ink absorption porous layer preferably contains organic fine particles and a binder and the ink receiving layer comprises inorganic fine particles and a binder.

An ink-jet paper having an ink receiving layer which has a porous layer at the outermost surface of the ink receiving layer, wherein the porous layer contains an organic fine particles which contains a polymer containing a repeating unit represented by Formula 1 as a copolymer constituent in a ratio of not less than 5% by weight and has a glass transition point Tg of not less than 70° C. and an average particle diameter of not more than 100 nm.

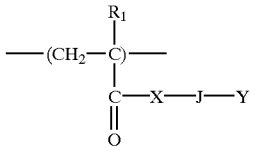

In the formula, X is —O— or —N($R_2$)—, $R_1$ is a hydrogen atom or a methyl group, $R_2$ is an alkyl group having 1–8 carbon atoms, and in case that X is —O—, J is an alkylene group having 2–18 carbon atoms which may have ether or thiother structure, and Y is a hydroxy, alkoxy, or carbamoyl group, and in case that X is —N($R_2$)—, J is a simple bond, or an alkylene group having 2–18 carbon atoms which may have ether or thiother structure, and Y is a hydrogen atom, a hydroxy, amino, alkoxy, or carbamoyl group $R_2$ is an alkyl group having 1–8 carbon atoms.

In the ink-jet recording paper the outermost porous layer contains the organic fine particles in a weight ratio of from 50% to 90% of the solid ingredient of the porous layer and inorganic fine particles in a weight ratio of from 10% to 50% to the weight of the organic fine particles.

In the ink-jet recording paper the thickness of the outermost porous layer of the ink receiving layer is within the range of from 0.1 μm to 5 μm and an inorganic fine particles-containing layer is provided under the porous layer, which contains an inorganic fine particles as the main ingredient and has a thickness of from 5 μm to 50 μm. The content of inorganic fine particles in the porous layer is 50 weight percent or more.

DETAILED DESCRIPTION OF THE INVENTION

The invention is described in detail below.

The ink-jet recording paper according to the invention is described.

The recording paper according to the invention has an ink receiving layer provided on at least one side of a support and the ink receiving layer has to have a high ink absorption speed to obtain a high quality image such as a photographic image. Accordingly, it is essential to provide the porous layer at the outermost surface of the ink receiving layer.

The porous layer provided on the outermost surface (the outermost porous layer) of the ink receiving layer is a layer substantially containing the later-mentioned organic fine particles. The effect of the organic fine particles contained in the outermost porous layer can be difficultly obtained when a little amount of the organic fine particles is contained in another layer.

In the outermost porous layer of the ink receiving layer, the weight ratio of the organic fine particles to the solid ingredients of the outermost porous layer is preferably not less than 50%. When the porous layer has a multi-layer structure in which the content of the organic fine particles is gradually decreased in every layer of from the outermost layer to the lower layer, the layers having the content of the organic fine particles of not less than 50% by weight to the solid ingredients of the layer are suitable as the outermost porous layer according to the invention.

The shape of the pore in the porous layer can be confirmed by the electron microscope observation. In the invention, it is preferable that the pores are connected with each other and not isolated. The diameter of the pore can be measured by the usual mercury intrusion porosimetry, which is common in the field of the ink-jet recording.

In many cases, in the porous type recording paper, the space between the filled particles is defined as the pore. Accordingly, the pore diameter can be expressed by the size of the filled particles and the filling ratio. The particle size of the particle to be used in the invention is preferably from 0.01 μm to 1 μm, more preferably from 0.02 μm to 0.1 μm, and the porosity of the porous layer is preferably from 10% to 70%, more preferably from 20% to 60%.

According to the finding by the investigation of the inventors, it is preferable to prevent the color fading of the image that the ink absorption speed after recording of the image recorded area is lowered from that of before image recording.

As method for realizing the decreasing of the ink absorbing speed after image recording, it can be applied to change the state of the pore before the image recording after image recording, for example, as follows:

1. The pores are disappeared.
2. The number of the pores is reduced.
3. The size of the pore is reduce.

In the invention, it is preferred to decrease the number of the pores, particularly the number of the pores at the outermost surface. In concrete, it is preferable that the height of the maximum peak being within the range of from 0.01 μm to 1 μm of the pore diameter distribution is reduced to not more than 40% of that before the image recording.

In another preferable embodiment, the diameter of the pore is reduced. In concrete, it is preferable that the maximum peak of the pore diameter being within the range of from 0.01 μm to 1 μm of the pore diameter distribution is decreased after image recording to not more than 60% of that before the image recording.

It is most preferred embodiment that any pore cannot be observed by the electron microscopic observation at the surface of the image recorded area for preventing the direct exposure of the recorded image to the harmful gas.

The reason of such the change of the shape of the pore is supposed as follows.

When the ink is jetted onto the ink-jet recording paper, water contained in the ink is gradually evaporated and the ratio of a water-permissible organic solvent in the liquid remained on the recording paper is gradually raised since the evaporation speed of the water-permissible organic solvent is lower than that of the water. Namely, a material insoluble in water and soluble in the water-permissible organic solvent is begun to be dissolved. Therefore, closing of the pore or decreasing of the pore diameter is occurred by the dissolution or swelling of all or a part of the organic fine particles after drying of the ink when the recording is carried out on the ink-jet recording paper containing the organic fine particles capable of being dissolved or swelled by the water permissible solvent.

It has been found by the inventors that the use of the following organic fine particles according to the invention is considerably effective as the concrete means for realizing the shape changing of the pore after the recording.

The organic fine particles according to the invention is described below.

For realizing the shape changing of the pore after the image recording as above-mentioned, the organic fine particles according to the invention has to satisfy the condition that the organic fine particles comprises a polymer containing not less than 5% by weight of a repeating unit represented by Formula 1 as a copolymer ingredient and the polymer has a glass transition point Tg of not less than 70° C. and an average diameter of nor more than 100 nm.

The repeating unit represented by Formula 1 is described below.

For obtaining the effect of the invention, the repeating unit represented by Formula 1 is preferably hydrophilic. Such the repeating unit can be obtained by polymerization of a hydrophilic monomer such as an acryl monomer, an acrylamide monomer and/or a methacrylamide monomer.

(1)

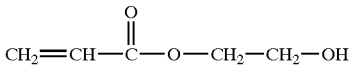

(2)

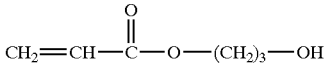

-continued (3)

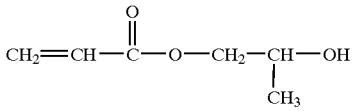

(4)

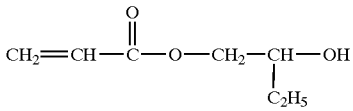

(5)

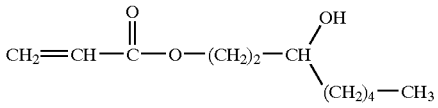

(6)

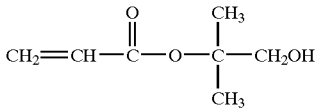

(7)

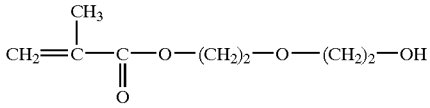

(8)

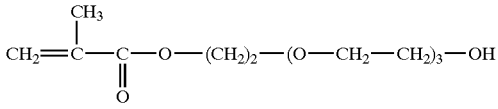

(9)

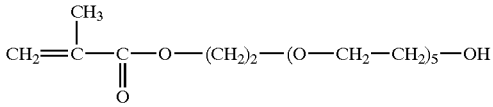

(10)

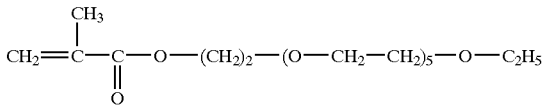

(11)

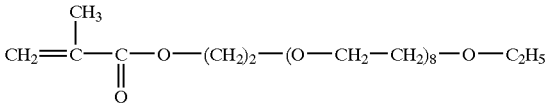

(12)

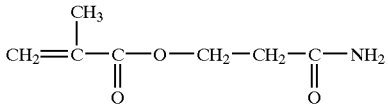

(13)

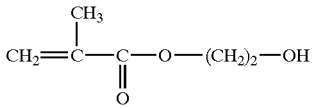

(14)

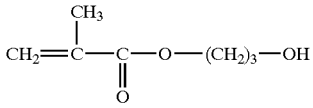

-continued (15)

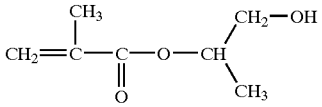

(16)

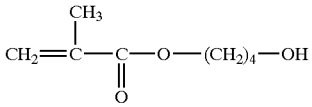

(17)

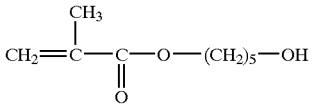

(18)

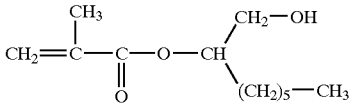

(19)

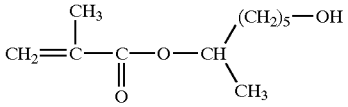

(20)

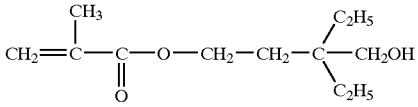

(21)

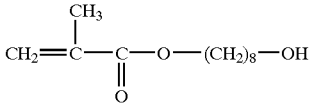

(22)

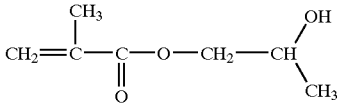

(23)

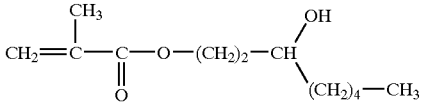

(24)

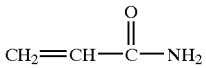

(25)

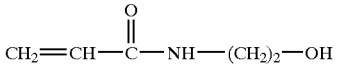

(26)

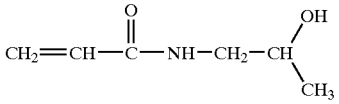

(27)

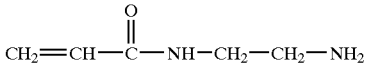

(28)

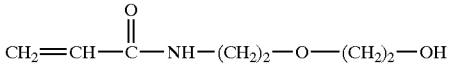

-continued (29)

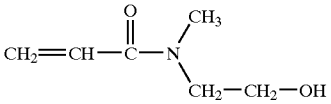

(30)

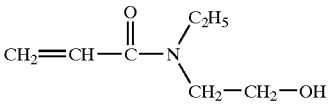

(31)

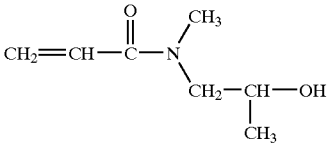

The partial structure represented by X, Y and the substituent Y in Formula 1 each gives the hydrophilicity to the repeating unit represented by Formula 1. It is preferable in the invention that the hydrophilicity is given by the substituent Y.

It is necessary that the organic fine particles according to the invention contains the specific repeating unit represented by Formula 1 as the copolymerized constituent. For accelerating the changing of the pore shape, it is necessary to have the repeating unit represented by Formula 1 in a ratio of not less than 5%, preferably not less than 10%, by weight.

It is preferable that the organic fine particles is insoluble in water even though it is hydrophilic. Accordingly, the content of the repeating unit represented by Formula 1 is preferably controlled so that the content is with in the range of from 10% to 50% by weight in the polymer of the organic fine particle.

A monomer having an ethylenic unsaturated group can be optionally selected as a monomer other than the forgoing polymer constituting the organic fine particles. The monomers may be used singly or in combination. Examples of the monomer include an alkyl ester and alkylamide of acrylic acid or methacrylic acid such as methyl acrylate, methyl methacrylate, ethyl acrylate, ethyl methacrylate, n-butyl acrylate, n-butyl methacrylate, i-butyl acrylate, i-butyl methacrylate, t-butyl acrylate, t-butyl methacrylate, cyclohexyl acrylate, cyclohexyl methacrylate, 2-ethylhexyl acrylate, 2-ethylhexyl methacrylate, lauryl acrylate, lauryl methacrylate, dimethylaminomethyl acrylate, diethylaminomethyl acrylate, dibutylaminomethyl acrylate, dihexylaminomethyl acrylate, dimethylaminoethyl acrylate, diethylaminoethyl acrylate, (t-butyl)aminoethyl acrylate, diidohexylaminoethyl acrylate, dihexylaminopropyl acrylate and di(t-butyl)aminohexyl acrylate, styrene, vinyltoluene, α-methyltoluene, vinyl acetate, acrylnitrile, methacrylonitrile, acrylic acid, methacrylic acid, fumaric acid, itaconic acid and maleic acid. Among them, styrene, methyl methacrylate and n-butyl acrylate are preferably used.

Concrete examples of the polymer are shown below, each of which contains the repeating unit represented by Formula 1 in a ratio of not less than 5% by weight which is usable as the constituent of the organic fine particles according to the invention.

L1

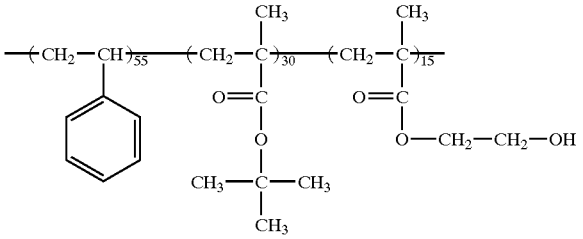

Tg103° C. average diameter: 30 nm

L2

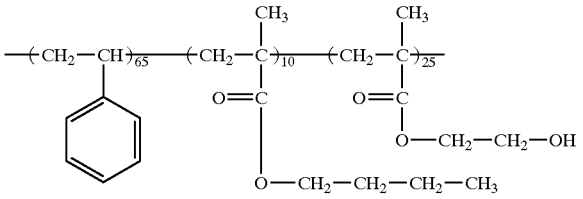

Tg72° C. average diameter: 80 nm

L3

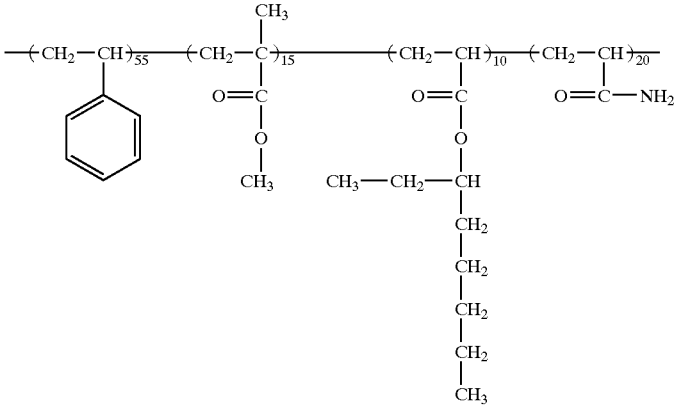

Tg87° C. average diameter: 50 nm

L4

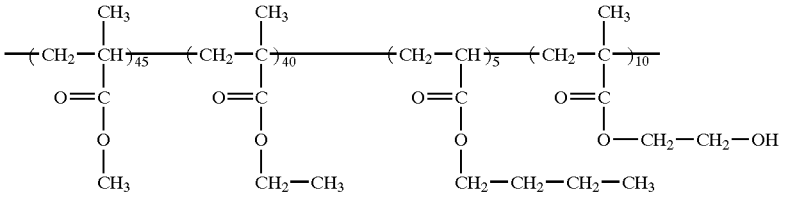

Tg74° C. average diameter: 20 nm

L5

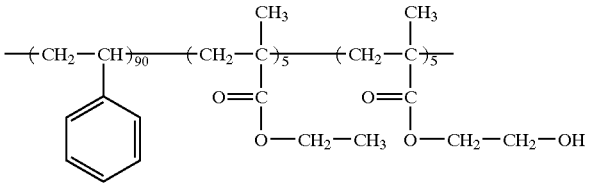

Tg97° C. average diameter: 30 nm

It is preferred that the organic fine particles is prepared in a state of an aqueous emulsion for preparation of a coating liquid. In such the case, the ionicity of the emulsion particle is preferably the same as that of the coating liquid or nonionic. It is most preferable that ionicity of the organic fine particles and the ingredients of the coating liquid are all cationic or nonionic. The ionicity of the organic fine particles emulsion can be controlled according to the ionicity of the dispersant or that of the copolymerized ingredients.

The ink-jet recording paper is usually used at an ordinary temperature. However, the storage condition before the use is not always the ordinary temperature. Particularly, the temperature is become very high in a closed car in summer. Accordingly, the ink-jet recording paper is required to be use with no hindrance if the recording paper is exposed to such the condition before the use thereof.

Therefore, it is necessary that the glass transition point Tg of the organic fine particles according to the invention is not less than 70° C., preferably not less than 80° C., more preferably from 90° C. to 120° C.

When the glass transition point Tg is less than 70° C., the organic fine particles tend to be adhered with together by heat. As a result of that, the pores at the surface of the recording paper is reduced in the size or in the number thereof so that the ink absorption speed tend to be lowered.

The Tg of the polymer constituting the organic fine particles according to the invention can be calculated based on the Tg of the homopolymer of each of the copolymer ingredients and the weight ratio of the monomers. For instance, the Tg of a polymer composed of styrene and n-butyl acrylate in a weight ratio of 4:1, in which the Tg of the styrene homopolymer is 100° C.=373° K and the Tg of the n-butyl acrylate homopolymer is −54° C.=219° K, is calculated as follows:

$$1/\{(1/373^\circ K)\times 4/5+(1/219^\circ K)\times 1/5\}=327^\circ K=54^\circ C.$$

Many data of Tg of homopolymers are described in "Polymer Hand Book", A Willey-Interscience Publication.

An average particle diameter of the organic fine particles is not more than 100 nm is necessary for obtaining the effects of the invention. The density of the printed image probably lowered by the influence of the light scattering when the average diameter of the organic fine particles exceeds 100 nm since the organic fine particles exist at the outermost surface of the ink-jet recording paper. The average diameter is preferably not more than 60 nm, more preferably from 20 nm to 40 nm in view of the density of the printed image. From another point of view, in the case of the average diameter of the organic fine particles is not more than 60 nm, the color fading of the printed image is inhibited when the amount of the organic solvent brought by the ink is small. When the average particle diameter is not less than 40 nm, the ink absorption speed of the recording paper is made excellent and the occurrence of beading at higher-speed printer can be inhibited.

The organic fine particles according to the invention is preferably synthesized in an aqueous medium by a usual emulsion polymerization method. The diameter of the particle can be controlled by a usual method such as selection the kind or amount of the emulsifying agent and the monomer composition so that the diameter is become within the range of from about 20 nm to about 100 nm.

The diameter of the organic fine particles can be determined by simple average or number average of the diameter of optionally selected many particles measured by the electron microscopic observation. The diameter of the individual particle is the diameter of a circle having the area the same as that of the particle. The average diameter also can be determined by another method, by which the organic fine particles are dispersed in a suitable medium and subjected to the laser diffraction scattering particle size distribution measurement. In such the case, the swelling of the particle by the dispersion medium has to be considered sometimes. However, the effect of the swelling is usually negligible. It is not necessary that the shape of the organic fine particles is true sphere. The shape of the particle also may be needle-like or planar. The particle diameter is determined from the volume in term of the sphere.

The content of the organic fine particles in the porous layer at the outermost surface of the ink receiving layer is preferably from 50% to 90% by weight for inhibiting the color fading of the image recorded by the ink-jet. The porous layer preferably contains the later-mentioned inorganic particle for preventing the adhesion of the organic fine particles with together and for further raising the ink absorption speed.

The content of the inorganic fine particles in the porous layer is preferably from 10% to 50% by weight. Here the content is a ratio to the solid ingredients of the layer, the space in the layer is neglected from the calculation.

The thickness of the outermost porous layer is preferably within the range of from 0.1 μm to 5 μm for raising the color fading prevention effect and maintaining a high printed image density and a high ink absorption speed. A lower layer mainly comprising the inorganic fine particles is preferably provided in the ink receiving layer for supplementing the ink absorption ability of the outermost layer of the ink receiving layer. The thickness of the lower layer mainly comprising the inorganic fine particles is preferably from 5 μm to 50 μm.

The porosity tends to be generally lowered in the porous layer containing the organic fine particles with a high filling ratio. Therefore, the thickness of the ink receiving layer tends to be large to hold the ink absorption amount when the ink receiving layer is constituted by a single layer. The layer comprising the inorganic fine particles and a hydrophilic binder can absorb much ink by a small thickness since such the layer has a high porosity.

Consequently, it is preferable to constitute the ink receiving layer having both of the porous layer containing the organic fine particles and the ink receiving layer comprising the inorganic fine particles and the hydrophilic binder. The ratio of the thickness of the organic fine particles-containing layer is preferably from 0.1% to 30%, more preferably from 0.5% to 20%, of the total thickness of the ink receiving layer.

The ink receiving layer relating to the ink-jet recording paper of the invention preferably has the inorganic particle-containing layer mainly comprising the inorganic fine particles and the hydrophilic binder provided under the porous layer containing the organic fine particles at the outermost surface thereof. It is more preferable that the inorganic fine particles-containing layer constitutes a porous layer.

Cited as examples of said inorganic fine particles may be white inorganic pigments such as precipitated calcium carbonate, heavy calcium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, false boehmite, aluminum hydroxide, lithopone, zeolite, and magnesium hydroxide.

In order to achieve high glossiness, the average diameter of said inorganic fine particles is preferably from 0.01 to 1 μm, and is more preferably from 0.02 to 0.1 μm.

The inorganic fine particles, as described herein, may be either primary particles or secondary particles. The diameter of said inorganic fine particles refers to the highest order particle diameter observed in the dried layer.

In the present invention, when composite particles comprised of inorganic fine particles and a small amount of organic polymers are employed, said composite particles are commonly designated as inorganic fine particles. In this case, the diameter of said inorganic fine particles also refers to the highest order particle diameter observed in the dried layer. Further, the ratio of organic polymers to inorganic fine particles in said composite particles comprised of inorganic fine particles and a small amount of organic polymers is commonly from 1/100 to 1/4 by weight.

The average diameter of said inorganic fine particles is determined as follows: the cross-section and surface of said porous layer are observed, employing an electron microscope, and the diameter of many randomly selected particles is obtained, whereby said diameter is determined as the simple average value (being the number average value). The diameter of each particle, as described herein, is the diameter of the circle having the same area as the projection area of said particle.

In the present invention, from the viewpoint of achieving lower cost as well as higher reflection density, said fine particles preferably have a lower refractive index. Silica, especially silica synthesized employing a gas phase method (hereafter referred to as a fumed silica), or colloidal silica is more preferred. Further, it is possible to use fumed silica subjected to a cation surface treatment, colloidal silica and alumina subjected to a cation surface treatment, colloidal alumina, pseudo boehmite.

Listed as examples of hydrophilic binders, employed in said ink receiving layer, are polyvinyl alcohol, gelatin, polyethylene oxide, polyvinylpyrrolidone, polyacrylic acid, polyacrylamide, polyurethane, dextran, dextrin, carrageenan (κ, ι, and λ), agar, Pullulan, water-soluble polyvinyl butyral, hydroxyethyl cellulose, and carboxymethyl cellulose. Said hydrophilic binders may be employed in combination of two or more types. The hydrophilic binder preferably employed in the present invention is polyvinyl alcohol.

In addition to common polyvinyl alcohol which is obtained by hydrolyzing polyvinyl acetate, said polyvinyl alcohol includes modified polyvinyl alcohol which is obtained by being subjected to cationic modification of the terminals, or anionic modification or anion modified polyvinyl alcohol having an anionic group.

The average degree of polymerization of preferably employed polyvinyl alcohol, prepared by hydrolyzing vinyl acetate, is preferably at least 1,000, and is more preferably from 1,500 to 5,000. The saponification ratio is preferably from 70 to 100 percent, and is most preferably from 80 to 99.5 percent.

Said cation modified polyvinyl alcohol includes polyvinyl alcohol having a primary, secondary, or tertiary amino group, or a quaternary ammonium group in its main chain or side chain as described, for example, in Japanese Patent Publication Open to Public Inspection No. 61-10483, and is prepared by copolymerizing an ethylenic unsaturated monomer, having a cationic group, with vinyl acetate.

Two or more polyvinyl alcohols, which are different from each other in the degree of polymerization and modified types, may be employed in combination.

The added amount of inorganic fine particles, employed in said ink receiving layer, varies markedly depending on the required ink absorption capacity, the void ratio of the porous layer, the types of inorganic fine particles, and the type of hydrophilic binders. However, said added amount is generally from 5 to 30 g per $m^2$ of the recording sheet, and is preferably from 10 to 25 g.

Further, the ratio of inorganic fine particles employed in said ink receiving layer to the hydrophilic binders is generally from 2:1 to 20:1, and is most preferably from 3:1 to 10:1.

In order to minimize the bleeding of images during storage after recording, cationic polymers are preferably employed.

Cited as examples of cationic polymers may be polyethyleneimine, polyallylamine, polyvinyl amine, dicyandiamide polyalkylene polyamine condensation products, polyalkylene polyamine dicyandiamide ammonium salt condensation products, dicyandiamide formalin condensation products, epichlorohydrin-dialkylamine condensation products, diallyldimethylammonium chloride polymers, diallyldimethylammonium chloride-$SO_2$ copolymers, polyvinylimidazole, vinylpyrrolidone-vinylimidazole copolymers, polyvinylpyridine, polyamidine, chitosan, cationized starch, vinylbenzyltrimethylammonium chloride polymers, (2-methacroyloxyethyl) trimethylammonium chloride polymers, and dimethylaminoethyl methacrylate polymers.

Further, listed as said polymers are cationic polymers described in "Kagaku Kogyo Jiho (Chemical Industry Update)", Aug. 15 and 25, 1998, and polymer dye fixing agents described in "Kobunshi Yakuzai Nyumon (Introduction to Polymer Pharmaceuticals)", published by Sanyo Kasei Kogyo Co., Ltd.

In order to regulate the physical strength of the ink receiving layer as well as to minimize cracking of the coated layer during coating and drying, it is preferable that hardeners be incorporated into the ink-jet recording sheet of the present invention.

Said hardeners are generally compounds which have a group capable of reacting with said hydrophilic binders, or compounds which promote reaction between different groups of said hydrophilic binders. They are suitably selected and employed depending on the type of hydrophilic binders.

Listed as specific examples of hardeners are, for example, epoxy based hardeners (diglycidyl ethyl ether, ethylene glycol diglycidyl ether, 1,4-butanediol diglycidyl ether, 1,6-diglycidylcyclohexane, N,N-glycidyl-4-glycidylpxyaniline, sorbitol polyglycidyl ether, and glycerol polyglycidyl ether), aldehyde based hardeners (formaldehyde and glyoxal), active halogen based hardeners (2,4-dichloro-4-hydroxy-1, 3,5-s-trizine, and bisvinylsulfonyl methyl ether), boric acid and salts thereof, borax, and aluminum alum.

When polyvinyl alcohol and/or cation modified polyvinyl alcohol is employed as the particularly preferred hydrophilic binder, it is preferable that hardeners, selected from boric acid and salts thereof, and epoxy based hardeners are employed. The most preferable hardeners are those selected from boric acid and salts thereof.

Boric acid or salts thereof refer to oxygen acid having a boron atom as the central atom and salts thereof, and specifically include orthoboric acid, diboric acid, metaboric acid, tetraboric acid, pentaboric acid, and octaboric acid, and salts thereof.

The employed amount of said hardeners varies depending on the types of hydrophilic binders, the types of hardeners, the types of inorganic fine particles, and the ratio of the hardeners to the hydrophilic binders. The amount is generally from 5 to 500 mg per g of the hydrophilic binder, and is preferably from 10 to 300 mg.

In addition to said additives, various other additives may be incorporated into the ink receiving layer, as well as other layers which may be desired for the ink recording sheet of the present invention. The following various types of additives cited as incorporated examples may be: polystyrene, polyacrylic acid esters, polymethacrylic acid esters, polyacrylamides, polyethylene, polypropylene, polyvinyl chloride, polyvinylidene chloride, or copolymers thereof; fine organic latex particles of urea resins or melamine resins; various types of cationic or nonionic surface active agents; UV absorbers described in Japanese Patent Publication Open to Public Inspection Nos. 57-74193, 57-87988, and 62-261476; anti-fading additives described in Japanese Patent Publication Open to Public Inspection Nos. 57-74192, 57-87989, 60-72785, 61-146591, 1-95091, and 3-13376; brightening agents described in Japanese Patent Publication Open to Public Inspection Nos. 59-42993, 59-52689, 62-280069, 61-242871, and 4-219266; pH regulators such as sulfuric acid, phosphoric acid, citric acid, sodium hydroxide, potassium hydroxide, and potassium carbonate; antifoaming agents, antiseptics, thickeners, antistatic agents, and matting agents.

Said ink receiving layer may be comprised of two or more layers. In this case, composition of each ink receiving layer may be the same or different.

Suitably employed as supports employed in the present invention may be ink-jet recording sheets. They may be water-absorptive supports but are preferably non-water-absorptive supports.

Listed as water-absorptive supports capable of being employed in the present invention may be, for example, common paper, cloth, and sheets and boards comprised of wood. Of these, paper is particularly preferred due to the excellent water absorbability of the base material itself, and low cost. Employed as paper supports may be those which are prepared by employing, as the main raw materials, wood pulp such as chemical pulp such as LBKP and NBKP, mechanical pulp such as GP, CGP, RMP, TMP, CTMP, CMP, and PGW, and waste paper pulp such as DIP. Further, if desired, suitably employed as raw materials may be various types of fibrous materials such as synthetic pulp, synthetic fibers, and inorganic fibers.

If necessary, various types of additives such as sizing agents, pigments, paper strength enhancing agents, fixing agents, optical brightening agents, wet paper strengthening agents, and cationic agents, may be incorporated into said paper supports.

It is possible to produce paper supports as follows. Fibrous materials such as wood pulp and various additives are blended and the resulting blend is applied to any of the various paper making machines such as a Fourdrinier paper machine, a cylinder paper machine, and a twin wire paper machine. Further, if necessary, it is possible to carry out a size press treatment employing starch and polyvinyl alcohol, various coating treatments, and calender finishing during paper making processes or in said paper making machine.

Non-water-absorptive supports capable of being preferably employed in the present invention include transparent supports as well as opaque supports. Listed as said transparent supports are films comprised of materials such as polyester resins, diacetate resins, triacetate resins, acrylic based resins, polycarbonate based resins, polyvinyl chloride based resins, polyimide based resins, cellophane, and celluloid. Of these, when employed for Overhead Projectors, those, which are radiation heat resistant, are preferred, and polyethylene terephthalate is particularly preferred. The thickness of said transparent supports is preferably from 50 to 200 $\mu$m.

Preferred as said opaque supports are, for example, resin coated paper (being so-called RC paper) in which at least one surface of the base paper is covered with a polyolefin resin layer comprised of white pigment, and so-called white PET prepared by incorporating white pigments such as barium sulfate into said polyethylene terephthalate.

For the purpose of enhancing the adhesion between said various supports and the ink receiving layer, it is preferable that prior to coating said ink receiving layer, said supports are subjected to a corona discharge treatment, as well as a subbing treatment. Further, the ink-jet recording sheets of the present invention are not necessary to be white and may be tinted.

It is particularly preferable that employed as the ink-jet recording sheets of the present invention be polyethylene laminated paper supports because recorded images approach conventional photographic image quality, and high quality images are obtained at relatively low cost. Said polyethylene laminated paper supports will now be described.

Base paper, employed in said paper supports, are made employing wood pulp as the main raw material, if necessary, together with synthetic pulp such as polypropylene and synthetic fiber such as nylon and polyester. Employed as said wood pulp may be any of LBKB, LBSP, NBKP, NBSP, LDP, NDP, LUKP, or NUKP. It is preferable that LBKP, NBSP, LBSP, NDP, and LDP, which are comprised of shorter fiber, are employed in a greater amount. However, the ratio of LBSP and/or LDP is preferably from 10 to 70 percent by weight.

Preferably employed as said pulp is chemical pulp (sulfate pulp and sulfite pulp). Further, also useful is pulp which has been subjected to a bleach treatment to increase its whiteness.

Into said base paper suitably incorporated may be sizing agents such as higher fatty acids and alkylketene dimers; white pigments such as calcium carbonate, talc, and titanium oxide; paper strength enhancing agents such as starch, polyacrylamide, and polyvinyl alcohol; optical brightening agent; moisture maintaining agents such as polyethylene glycols; dispersing agents; and softeners such as quaternary ammonium salts.

The degree of water freeness of pulp employed for paper making is preferably from 200 to 500 ml under CSF Specification. Further, the sum of weight percent of 24-mesh residue and weight percent of 42-mesh calculated portion regarding the fiber length after beating, specified in JIS-P-8207, is preferably between 30 and 70 percent. Further, the weight percent of 4-mesh residue is preferably 20 percent by weight or less.

The weight of said base paper is preferably from 30 to 250 g/m$^2$, and is most preferably from 50 to 200 g/m$^2$. The thickness of said base paper is preferably from 40 to 250 $\mu$m.

During the paper making stage or after paper making, said base paper may be subjected to a calendering treatment to result in excellent smoothness. The density of said base paper is generally from 0.7 to 1.2 g/m$^3$ (JIS-P-8118). Further, the stiffness of said base paper is preferably from 20 to 200 g under the conditions specified in JIS-P-8143.

Surface sizing agents may be applied onto the base paper surface. Employed as said surface sizing agents may be the same as those above, capable of being incorporated into said base paper.

The pH of said base paper, when determined employing a hot water extraction method specified in JIS-P-8113, is preferably from 5 to 9.

Polyethylene, which is employed to laminate both surfaces of said base paper, is mainly comprised of low density polyethylene (LDPE) and/or high density polyethylene (HDPE). However, other LLDPE or polypropylene may be partially employed.

Specifically, as is generally done with photographic paper, the polyethylene layer located on the ink receiving layer side is preferably constituted employing polyethylene into which rutile or anatase type titanium oxide is incorporated so that opacity as well as whiteness is improved. The content ratio of said titanium oxide is generally from 3 to 20 percent by weight with respect to polyethylene, and is more preferably from 4 to 13 percent by weight.

It is possible to employ said polyethylene coated paper as glossy paper. Further, in the present invention, it is possible to employ polyethylene coated paper with a matt or silk surface, as obtained in the conventional photographic paper, by carrying out an embossing treatment during extrusion coating of polyethylene onto said base paper.

In said polyethylene coated paper, it is preferable to maintain a paper moisture content of 3 to 10 percent by weight.

It is possible to apply various types of ink receiving layers, such as a porous layer and a sublayer, arranged as required, onto a support, employing a usual method. The preferred methods are that the coating composition constituting each layer is applied onto a support and subsequently dried. In this case, it is possible to simultaneously apply two or more layers onto said support, and simultaneous coating is particularly preferred in which all hydrophilic binder layers are simultaneously coated.

Employed as coating methods are a roll coating method, a rod bar coating method, an air knife coating method, a spray coating method, and a curtain coating method. In addition, preferably employed is the extrusion coating method employing a hopper, described in U.S. Pat. No. 2,681,294.

When each non-recorded area of the ink-jet recording sheets, described in the invention, is subjected to Bristow's Measurement, the water absorption amount of said non-recorded area is preferably from 10 to 30 $ml/m^2$ during a contact time of 0.8 second.

Listed as specific examples of ejection systems of the ink-jet recording of the present invention may be an electrical-mechanical conversion system (for example, a single cavity type, a double cavity type, a bender type, a piston type, a share mode type, and a shared wall type), an electrical-thermal conversion system (for example, a thermal ink-jet type, and a bubble jet type), and an electrostatic suction type (for example, an electric field control type and a slit jet type), and a discharge system (for example, a spark jet type).

The ink employed in the present invention is a water soluble dye ink, and comprises water, water-soluble organic solvents, and water-soluble dyes and further it is possible to add other additives, if necessary. Specifically, water-soluble organic solvents are incorporated, without fail, for the purpose of minimizing dye deposition near nozzles due to drying. Said water-soluble organic solvents are any of the organic solvents which are soluble in water, and may be employed in combination of several types.

The boiling point of said organic solvents is preferably 120° C. or higher. Further, it is preferable that water-soluble organic solvents having an SP (being a solubility parameter) of 18.414 to 30.69 are incorporated in an amount of 10 to 30 percent by weight.

The SP (Solubility Parameter) value, as described herein, refers to the solubility parameter and is an important scale to estimate the solubility of substances. Herein, a unit is $[MPa]^{1/2}$ which is a value at 25° C. Said SP values of organic solvents are described on page IV-337 of J. Brandrup, et al., "Polymer Handbook", A Wiley-Interscience Publication, and other publications.

Listed as examples of water-soluble organic solvents are alcohols (for example, butanol, isobutanol, secondary butanol, tertiary butanol, pentanol, hexanol, cyclohexanol, and benzyl alcohol); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, and thioglycol); alkyl ethers of polyhydric alcohol (for example, ethylene glycol monomethyl ether, ethylene glycol monoethyl ether, ethylene glycol monobutyl ether, ethylene glycol dimethyl ether, diethylene glycol monomethyl ether, diethylene glycol monoethyl ether, diethylene glycol monobutyl ether, diethylene glycol dimethyl ether, diethylene glycol diethyl ether, triethylene glycol monoethyl ether, triethylene glycol monomethyl ether, triethylene glycol monobutyl ether, triethylene glycol diethyl ether, triethylene glycol dimethyl ether, tetraethylene glycol monomethyl ether, tetraethylene glycol monoethyl ether, tetraethylene glycol monobutyl ether, tetraethylene glycol dimethyl ether, and tetraethylene glycol diethyl ether); amines (for example, ethanolamine, diethanolamine, triethanolamine, N-methyldiethanolamine, N-ethyldiethanolamine, morpholine, N-ethylmorpholine, ethylenediamine, diethylenetriamine, triethylenetetramine, tetraethylenepentamine, polyethyleneimine, pentamethyldiethylenetriamine, and tatramethylpropylenediamine); amides (for example, formamide, N,N-dimethylformamide, and N,N-dimethylacetamide); heterocycles (for example, 2-pyrrolidone, N-methyl-2-pyrrolidone, cyclohexylpyrrolidone, 2-oxazolidone, and 1,3-dimethyl-2-imidazilidinone); sulfoxides (for example, dimethylsulfoxide); and sulfones (for example, sulfolane).

Particularly preferred water-soluble organic solvents are polyhydric alcohol, alkyl ethers of polyhydric alcohols, and heterocycles, and 2 or 3 types are preferably selected from them. Preferably employed as hydrophilic organic solvents are ethylene glycol, diethylene glycol, triethylene glycol, glycerin, diethylene glycol monobutyl ether, triethylene glycol monobutyl ether, triethanolamine, and 2-pyrrolidinone, 1,5-pentanediol and 1,2-hexanediol.

Said ink comprises at least one of the water-soluble dyes such as direct dyes, acidic dyes, basic dyes, reactive dyes or food dyes which are applied for ink-jets. The concentration of dyes in said ink is commonly from 0.1 to 5 percent.

In order to improve wettability to recording sheets, the surface tension of said ink is commonly in the range of 0.025 N/m to 0.060 N/m at 20° C., and is preferably in the range of 0.030 N/m to 0.050 N/m.

In order to improve solubility dyes in said ink, it is preferable that the pH be maintained at no lower than 7. In order to adjust the pH to the desired value, pH regulators may be employed.

Listed as other additives of said ink are, for example, sequestering agents, antifungal agents, viscosity modifying agents, surface tension adjusting agents, wetting agents, surface active agents, and antirusting agents. The concentration of these additives in said ink is generally from 0.01 to 5 percent.

The preferable maximum ink ejection amount of the present invention is from 10 to 35 ml/m$^2$.

EXAMPLES

The invention is concretely described below referring examples. In the examples, "%" is "% by weight" as long as no specific description is accompanied.

Example 1

Preparation of Silica-Cationic Polymer Dispersion 1

To 100 g of 15% aqueous solution of cationic polymer P1, 500 g of 25% aqueous dispersion of silica fine particles QS-20, manufactured by Tokuyama Corp., having an average primary particle diameter of 12 nm was added, and then 3.0 g of boric acid and 0.7 g of borax was further added. The mixture was dispersed by a high speed homogenizer. Thus a bluish white Silica-Cationic Polymer Dispersion 1 was prepared.

Preparation of Coating Liquid 1

Six hundreds and ten grams of Silica-Cationic Polymer Dispersion 1 was heated by 45° C. and then 5 ml of 10% solution of polyvinyl alcohol PVA 203, manufactured by Kuraray Co., Ltd., and 290 ml of polyvinyl alcohol PVA 245, manufactured by Kuraray Co., Ltd., were added. The volume of the mixture was made up to 1,000 ml by purified water having a temperature of 45° C. Thus translucent Coating Liquid 1 was prepared.

Preparation of Ink-jet Recording Papers 1 Through 16

Preparation of Ink-jet Recording Paper 1

The Coating Liquid 1 was coated by a wire bar coater on a paper support with a thickness of 230 μm, the both of the surfaces of which were laminated with polyethylene, and dried. The dried coated paper was stored in a thermostat at a temperature of 40° C. and a relative humidity of 80% fro 12 hours to prepare Ink-jet Recording Paper 1. The thickness of the dried layer was 35 μm. Hereinafter, "Ink-jet Recording Paper" is referred to as "Recording Paper".

Preparation of Recording Paper 2

A coating liquid having the following composition was coated on the coated surface of Recording Paper 1 and dried by air of 60° C. to prepare Recording Paper 2. The thickness of the newly coated layer was 1 μm in the dry state.

Composition of the coating liquid

| | |
|---|---|
| Dispersion of organic fine particles L1) (Solid component concentration: 10% by weight) | 100 g |
| Silica-Cationic Polymer Dispersion 1 | 20 g |

Preparation of Recording Papers 3 Through 16

Recording Papers 3 through 16 were prepared in the same manner as in Recording Paper 2 except that the composition of the coating liquid and the layer thickness were changed as shown in Table 1, provided that, in Recording Paper 7, Recording Paper 1 used as the support was replaced by a coated paper the same as Recording Paper 1 except that the thickness of the coated layer of Coating Liquid 1 was changed to 4 μm in the dried state.

Organic fine particles Dispersions L2 through L9 were prepared in the same manner as in the preparation of dispersion of Organic fine particles L1 except that the organic particle was changed as shown in Table 1.

L6

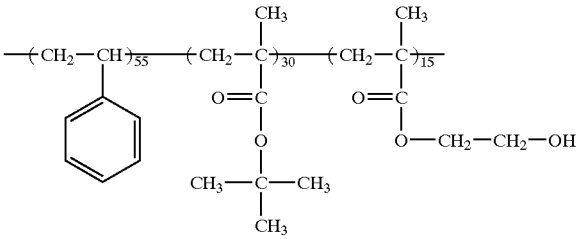

Tg103° C. average diameter: 120 nm

L7

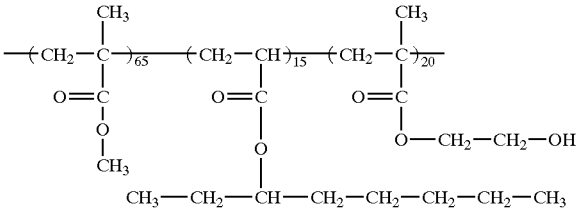

Tg66° C. average diameter: 40 nm

L8

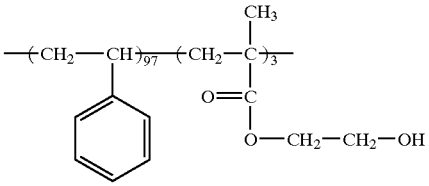

Tg100° C. average diameter: 30 nm

L9

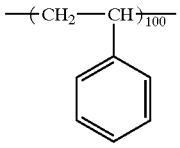

Tg100° C. average diameter: 30 nm

P1

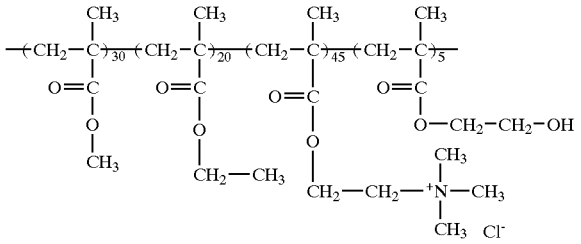

Thus prepared Recording Papers 1 through 16 are shown in Table 1.

TABLE 1

| Recording Paper 1 | Constitution of organic fine particle contained in the outermost porous layer: Organic fine particle | Dry layer thickness (μm) | Content of repeating unit represented by Formula 1 (weight-%) | Glass transition point (° C.) | Average diameter of organic fine particles (nm) | Adding amount of Silica-Cationic Polymer 1 (g) | Remarks |
|---|---|---|---|---|---|---|---|
| 1 | — | — | — | — | — | — | Comp. |
| 2 | L1 | 1 | 15 | 103 | 30 | 20 | Inv. |
| 3 | L2 | 0.1 | 25 | 72 | 25 | 36 | Inv. |
| 4 | L3 | 4 | 20 | 87 | 20 | 7 | Inv. |
| 5 | L4 | 0.5 | 10 | 74 | 10 | 10 | Inv. |
| 6 | L5 | 2 | 5 | 97 | 5 | 30 | Inv. |
| 7 | L1 | 4 | 15 | 103 | 30 | 20 | Inv. |
| 8 | L1 | 6 | 15 | 103 | 30 | 20 | Inv. |
| 9 | L1 | 0.1 | 15 | 103 | 30 | 20 | Inv. |
| 10 | L1 | 1 | 15 | 103 | 30 | 3 | Inv. |
| 11 | L1 | 1 | 15 | 103 | 30 | 0 | Inv. |
| 12 | L1 | 1 | 15 | 103 | 30 | 45 | Inv. |
| 13 | L6 | 1 | 15 | 103 | 120 | 20 | Comp. |
| 14 | L7 | 1 | 20 | 66 | 40 | 20 | Comp. |
| 15 | L8 | 1 | 3 | 100 | 30 | 20 | Comp. |
| 16 | L9 | 1 | — | 100 | 30 | 20 | Comp. |

Comp.: Comparative,
Inv.: Inventive

Preparation of Ink 1

Ink 1 having the following composition was prepared.

| | |
|---|---|
| Water | 68.5 parts |
| Diethylene glycol monobutyl ether | 12 parts |
| Diethylene glycol | 10 parts |
| Glycerol | 8 parts |
| C. I. Direct Blue 86 | 1 part |
| Surfactant Surfinol 465 (Nissin Chemical Industry Co., Ltd.) | 0.5 parts |

Preparation of Recorded Image on the Recording Paper

Ink 1 was charged into the ink tank of an ink-jet printer MJ-800C, manufactured by Seiko Epson Co., Ltd., and a uniform solid image was printed onto each of Recording Papers 1 through 16. The jetting amount of the ink was 12 $ml/m^2$.

The image printed on each of Recording Papers 1 through 16 was subjected to the following evaluations of color fading, beading, heatproof temperature and the printed image density.

Evaluation of Color Fading

The recording paper carrying the printed image was stood near window of an office at ordinary temperature and humidity for 6 months so that the printed image was exposed to atmosphere but not to direct sun light. The reflective density of the image was measured before and after the standing by monochromatic red light and the remaining ratio of the image, the ratio of the density after standing to the density before standing, was calculated.

Electron Microscopic Observation

By the electron microscopic observation, countless pores each having a diameter of from 5 nm to 100 nm were observed on the coated surface of no image recorded area of each of Recording Papers 1 through 16. It was observed by the electron microscopic observation of the surface of the solid image recorded area of the recording paper that the diameter or number of the pore was reduced in all the recording papers other than Recording Papers 1, 15 and 16. Particularly, the pore was almost not observed at the surface of each of Recording Paper 2, 3, 8, 10 and 11.

Evaluation of Beading

The solid image formed on each of Recording Papers 1 through 16 was visually observed and ranked according to the following norm.

A: Beading was not observed by the observation at a distance of 30 cm.

B: Beading was not observed by the observation at a distance of 60 cm.

C: Beading was observed by the observation at a distance of 60 cm.

The image ranked into A or B is acceptable for the practical used.

Evaluation of Heatproof Temperature

Recording Papers 1 through 16 were each stored for 3 days at the conditions of 50° C., 60° C. and 70° C. After cooled by the room temperature, the solid image was printed out on each of the recording papers in the same manner as in the above-mentioned. The highest storage temperature at which the ink can be absorb within 5 seconds by the recording paper was defined as the heatproof temperature of the recording paper. When a recording paper after storage at 50° C. lost the ink absorbing ability, the heatproof temperature of the recording paper is represented by "not more than 50". The ink is regarded to be absorbed when another paper is pressed upon an ink jetted portion of the recording paper and the another paper is not inked.

Evaluation of Printing Density

A black solid image was printed on each of Recording Papers 1 through 16 using the original ink for MJ-800C. The reflective density of the printed image was measured by green light.

Thus obtained results of the measurements and evaluations are shown in Table 2.

TABLE 2

| Recording Paper No. | Color fading | Beading | Heatproof temperature | Printed image density | Remarks |
|---|---|---|---|---|---|
| 1 | 43% | A | 70 | 2.23 | Comp. |
| 2 | 98% | A | 70 | 2.21 | Inv. |
| 3 | 95% | A | 70 | 2.16 | Inv. |
| 4 | 92% | A | 70 | 2.18 | Inv. |
| 5 | 93% | A | 70 | 2.22 | Inv. |
| 6 | 90% | A | 70 | 2.17 | Inv. |
| 7 | 98% | B | 70 | 2.18 | Inv. |
| 8 | 96% | B | 70 | 2.09 | Inv. |
| 9 | 92% | A | 70 | 2.2 | Inv. |
| 10 | 95% | B | 60 | 2.16 | Inv. |
| 11 | 97% | B | 60 | 2.23 | Inv. |
| 12 | 85% | A | 70 | 2.14 | Inv. |
| 13 | 92% | A | 70 | 1.88 | Comp. |
| 14 | 90% | A | Not more than 50 | 2.22 | Comp. |
| 15 | 54% | A | 70 | 2.21 | Comp. |
| 16 | 50% | A | 70 | 2.2 | Comp. |

Comp. Comparative,
Inv.: Inventive

It is cleared that the samples according to the invention show a small color fading, inhibited beading, high heatproof temperature and high printing density.

Example 2

Preparation of Recording Papers 17 Through 20

Recording Papers 17 through 20 were each prepared in the same manner as in Recording Paper 1 except that the average diameter of L1 was changed to 40 nm, 50 nm, 60 nm and 70 nm, respectively. Thus obtained recording papers were subjected to the following evaluations.

Ink 1 was charged into the ink tank of a jet printer PM-820C, manufactured by Seiko Epson Co., Ltd., and the solid image was printed on Recording Papers 1, 2 and 17 through 20 in the two-direction printing mode. The jetting amount of the ink was 8 ml/m$^2$.

Evaluation of Beading

The solid image formed on each of Recording Papers 1, 2 and 17 through 20 was visually observed and ranked according to the foregoing norm.

Evaluation of Color Fading

The color fading was evaluated in the foregoing manner as to the solid image formed on each of Recording Papers 1, 2 and 17 through 20. The time of the evaluation was not the same as the evaluation in Example 1.

TABLE 3

| Recording Paper No. | Average particle diameter (nm) | Color fading | Beading | Remarks |
|---|---|---|---|---|
| 1 | | 35 | A | Comp. |
| 2 | 30 | 98 | B | Inv. |
| 17 | 40 | 96 | A | Inv. |
| 18 | 50 | 95 | A | Inv. |
| 19 | 60 | 92 | A | Inv. |
| 20 | 70 | 81 | A | Inv. |

Comp.: Comparative,
Inv.: Inventive

As is shown in the above, samples containing the organic fine particles having the average diameter of from 40 nm to 60 nm are preferable since the samples are excellent in the resistively to color fading when the ink amount is small and the beading is difficultly occurred when the printing speed is high.

An ink-jet recording paper can be provided by the invention, which inhibits the color fading and the beading occurrence and has a high heatproof temperature and image density.

What is claimed is:

1. An ink-jet paper having a support provided thereon an ink receiving layer and a porous layer provided on the ink receiving layer, wherein the porous layer contains organic particles with an average particle diameter of not more than 60 nm, the organic particles contain a polymer having a glass transition point Tg of not less than 70° C. and comprising a repeating unit represented by Formula 1 in an amount of not less than 5% by weight, Formula 1

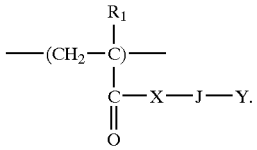

in the formula, X is —O— or —N($R_2$)—, $R_1$ is a hydrogen atom or a methyl group, $R_2$ is an alkyl group having 1–8 carbon atoms, and when X is —O—, J is an alkylene group having 2–18 carbon atoms which may have ether or thioether structure, and Y is a hydroxy, alkoxy, or carbamoyl group, and when X is —N($R_2$)—, J is a simple bond, or an alkylene group having 2–18 carbon atoms which may have ether or thioether structure, and Y is a hydrogen atom, a hydroxy, amino, alkoxy, or carbamoyl group.

2. The ink-jet recording paper of claim 1, wherein X is —O—.

3. The ink-jet recording paper of claim 1, wherein Y is a hydroxy group.

4. The ink-jet recording paper of claim 1, wherein $R_2$ is an alkyl group having 1 to 8 carbon atoms.

5. The ink-jet recording paper of claim 1, wherein the organic particles have an average particle diameter of not more than 40 nm.

6. The ink-jet recording paper of claim 1, wherein the organic particles are insoluble in water and soluble in an organic solvent.

7. The ink-jet recording paper of claim 1, wherein the porous layer contains inorganic particles.

8. The ink-jet recording paper of claim 7, wherein the porous layer contains the organic particles in a weight ratio of from 50% to 90% of solid ingredient of the porous layer and the inorganic particles in a weight ratio of from 10% to 50% to the weight of the organic particles.

9. The ink-jet recording paper of claim 7, wherein the inorganic particles have an average diameter of from 0.01 to 1 $\mu$m.

10. The ink-jet recording paper of claim 1, wherein the porous layer has a thickness of from 0.1 μm to 5 μm and the ink receiving layer contains inorganic particles and has a thickness of from 5 μm to 50 μm.

11. The ink-jet recording paper of claim 9, wherein the ink receiving layer is a porous layer.

12. The ink-jet recording paper of claim 1, wherein the ink receiving layer comprises inorganic particles and a binder.

13. An ink-jet image recording method comprising jetting an ink comprising a water soluble dye ink, water and a water-soluble organic solvent to the ink-jet recording paper of claim 1, wherein the organic particles are soluble in the water-soluble organic solvent.

14. The ink-jet recording paper of claim 1, wherein the polymer of the organic particles contains the repeating unit represented by Formula 1 of from 10% to 50% by weight in the polymer.

* * * * *